US009907715B2

(12) United States Patent
Zhou et al.

(10) Patent No.: US 9,907,715 B2
(45) Date of Patent: Mar. 6, 2018

(54) ADJUSTABLE ELECTRIC BED

(71) Applicant: CHANGZHOU YUFENG FURNITURE COMPANY LIMITED., Changzhou, Jiangsu (CN)

(72) Inventors: Jie Zhou, Sydney (AU); Chulai Mao, Changzhou (CN)

(73) Assignee: Changzhou Yufeng Furniture Company Limited, Henglin Town, Wujin District, Changzhou, Jiangsu (CN)

( * ) Notice: Subject to any disclaimer, the term of this patent is extended or adjusted under 35 U.S.C. 154(b) by 0 days.

(21) Appl. No.: 15/449,855

(22) Filed: Mar. 3, 2017

(65) Prior Publication Data

US 2017/0252244 A1 Sep. 7, 2017

(30) Foreign Application Priority Data

Mar. 3, 2016 (CN) ..... 2016 2 0161841 U

(51) Int. Cl.

| | |
|---|---|
| ***A47C 21/04*** | (2006.01) |
| ***A61G 7/018*** | (2006.01) |
| ***A47C 17/04*** | (2006.01) |
| ***A61G 7/015*** | (2006.01) |

(52) U.S. Cl.

CPC ..... *A61G 7/018* (2013.01); *A47C 17/04* (2013.01); *A61G 7/015* (2013.01)

(58) Field of Classification Search

CPC ..... A47C 21/04
USPC ..... 5/616–618, 613, 620
See application file for complete search history.

(56) References Cited

U.S. PATENT DOCUMENTS

2014/0201916 A1* 7/2014 Ermalovich ..... A47C 20/041 5/618

* cited by examiner

*Primary Examiner* — Fredrick Conley
(74) *Attorney, Agent, or Firm* — Global IP Services; Tianhua Gu

(57) ABSTRACT

An adjustable electric bed, comprising a bed frame, a plurality of mutually articulated bed boards and a driving motor for driving the bed boards to rise and fall, wherein the plurality of bed boards at least comprise a head bed board, a fixed bed board, a leg bed board and a foot bed board which are articulated successively, wherein the fixed bed board is fixed with the bed frame, the undersurface of the head bed board is fixedly provided with a head connector, wherein the driving motor at least comprises a head motor and a leg motor, two ends of the head motor are respectively articulated with the bed frame and the head connector, the undersurface of the leg bed board is fixedly provided with leg connector, two ends of the leg motor are respectively articulated with the bed frame and the leg connector.

10 Claims, 2 Drawing Sheets

ADJUSTABLE ELECTRIC BED

TECHNICAL FIELD

The invention relates to an adjustable electric bed.

BACKGROUND ART

In nowadays society, people pay more and more attention to the quality of life and have more and more stringent requirement on healthy sleep. People need the adjustable electric bed which can improve the sleep comfort because of being able to adjust the angle between the bed head and foot.

The existing adjustable electric bed generally comprises driving motors, complex mechanical structure and movable bed boards, the driving motors drive the complex mechanical structure, so as to adjust the height and position of the bed board via the mechanical structure.

However, both the internal mechanical structure and the drive manner of the motor of the existing adjustable electric bed are relatively complex, generally comprising complex drive system and driving the electric bed and adjusting the position via numerous rotational stands, power plants, support bars, support lugs and various actuating gears such as cross bar, vertical bar and rotary rod. Such large and complex drive system makes the existing electric bed complex for production with high cost and troublesome for assembling and maintenance.

CONTENTS OF THE INVENTION

It should be noted that the invention aims at overcoming one or more of the disadvantages which have been found in the background art.

To this end, the invention proposes an adjustable electric bed, comprising a bed frame, a plurality of bed boards which are mutually articulated and a driving motor for driving the bed board to rise and fall, wherein the plurality of bed boards at least comprise a head bed board, a fixed bed board, a leg bed board and a foot bed board which are articulated successively, wherein the fixed bed board is fixed with the bed frame, the undersurface of the head bed board is fixedly provided with a head connector, wherein the driving motor at least comprises a head motor and a leg motor, two ends of the head motor are respectively articulated with the bed frame and the head connector, the undersurface of the leg bed board is fixedly provided with a leg connector, and two ends of the leg motor are respectively articulated with the bed frame and the leg connector. Through the above arrangements, the adjustable electric bed of the invention is able to drive via the head bed board and the leg bed board by the head motor and the leg motor, so as to adjust the position of the electric bed and improve the comfort of the user. The adjustable electric bed of the invention does not comprises complex mechanical structure, and therefore, it is advantageous to keep the inside of the electric bed clean and tidy, at the same time, the compact design is advantageous to reduce the weight of the electric bed and is convenient for manufacturing and reducing the production cost, while providing the consumers with more choices.

In addition, the adjustable electric bed of the invention may also comprise one or more of the following features:

Furthermore, the foot bed board is connected with the bed frame by a movable support bar, one end of the support bar is articulated with said bed frame, the other end is articulated with the foot bed board, and when the leg motor drives the leg bed board to rise and fall, the support bar supports the foot bed board, such arrangement is more ergonomic and makes the user experience more comfortable.

Furthermore, the bed frame comprises a fixed platform protruding upwards along the horizontal plane of the bed frame, and several fixed blocks, wherein the fixed platform is used for fixing the fixed bed board, said several fixed blocks play a role of supporting when the head bed board, the leg bed board and the foot bed board are at the horizontal plane, thus, when all the bed boards are in the horizontal position, the fixed platform and the fixed blocks respectively supports the fixed bed board and the rest bed boards, so as to avoid the bed board collapse.

Furthermore, at least one of said several fixed blocks is fixed at the position in the bed frame corresponding to the hinge joint of the leg bed board and the foot bed board at the horizontal plane, which reduces the force born by the hinge joint which bears relatively concentrated forces, and reduces the probability of damage to the hinge joint.

Furthermore, the head motor and the leg motor comprise drive ends and push rods, wherein the drive end of the head motor is articulated with the bed frame, and the end of its push rod is articulated with the head bed board; the drive end of the leg motor is articulated with the bed frame, and the end of its push rod is articulated with the leg bed board.

Furthermore, the drive ends of the head motor and the leg motor and the ends of the push rods are arranged not within the same horizontal plane, thus the head motor and the leg motor have initial arm of force when being driven, so as to be convenient for applying force.

Furthermore, the head connector and the leg connector are respectively arranged at the undersurfaces of the head bed board and of the leg bed board along the same straight line, which overcomes the drawbacks of the electric bed, such as the miscellaneous internal mechanical structures, etc., meets the requirements that the inside of the bed is more compact and clean and is convenient for maintaining. The product has lighter weight and is easier to impress the consumers in the aspect of marketing.

Furthermore, the head connector and the leg connector are arranged respectively along the center lines of the head bed board and of the leg bed board, and double motors are arranged face to face along the center line, which saves effort for the drive of motor, reduces the current surge value and improves the product service life and safety.

Furthermore, the lengths of the head connector and the leg connector are respectively more than half the lengths of the head bed board and of the leg bed board, so as to improve the stability of head connector and foot connector.

Furthermore, the bed frame is made of cold-drawn steel for furniture tube, and this type of rectangular cold-drawn steel for furniture has good quality, good surface quality, light weight and high weld strength and is not easily deformed.

Thus, the adjustable electric bed of the invention simplifies the complex mechanical structure of the electric bed in the art while ensuring sufficient mechanical strength, realizes simplified production, reduces the cost, is advantageous for assembling and maintenance, and has the advantage of meeting more users' demands.

BRIEF DESCRIPTION OF THE DRAWINGS

It should be understood that all features, variants and/or specific embodiments in the invention may be combined in many combinations, except the case of apparent contradiction or incompatibility.

Other advantages and features of the invention will become apparent by reading the following specific embodiments, given by way of non-limiting example, with reference to the accompany drawings, in which.

BEST MODE FOR CARRYING OUT THE INVENTION

It should be understood that the above figures are not in real proportion, but are only the diagrams used for explaining various preferential features of the fundamental principles of the invention. The design features disclosed by the invention, for example the size, the direction, the orientation and the shape, shall be determined according to specific application and operating environment.

Hereinafter, the invention will be described in detail in combination with the embodiments and the accompanying drawings. In these figures, the same reference numbers designate identical or equivalent elements of the invention in all figures.

Figure 1:
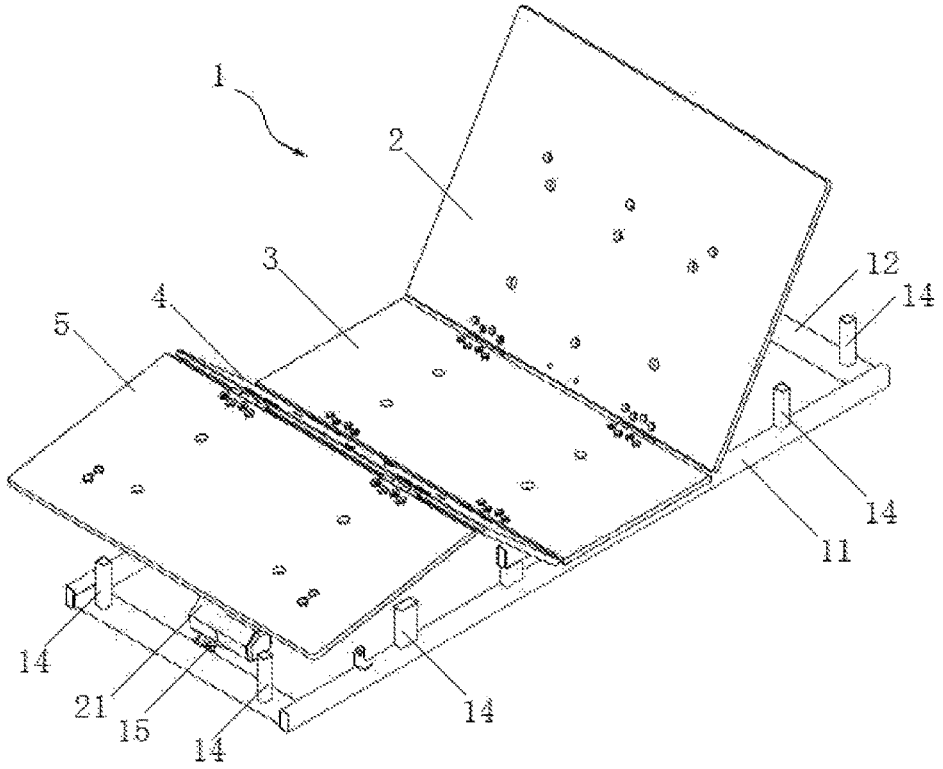
FIG. 1 is a perspective view showing an adjustable electric bed according to the embodiment of the invention.

Referring to FIG. 1, which shows the adjustable electric bed according to the embodiment of the invention, comprising a bed frame, a driving motor and several mutually articulated bed boards, the bed boards are, in order, a head bed board 2, a fixed bed board 3, a leg bed board 4 and a foot bed board 5, and the driving motor comprises a head motor for driving the head bed board 2 and a leg motor for driving the leg bed board 4.

In the non-limiting example of FIG. 1, the bed frame comprises a substantially rectangular frame, a fixed platform 13 protruding upwards along the horizontal plane of the bed frame, and several fixed blocks 14, wherein the fixed bed board 3 is fixed in the bed frame, and the height of the fixed platform 13 is equal to the height of each fixed block 14, in this way, various bed boards are uniformly supported by the fixed platform 13 and the fixed blocks 14 when being positioned horizontally.

Figure 2:
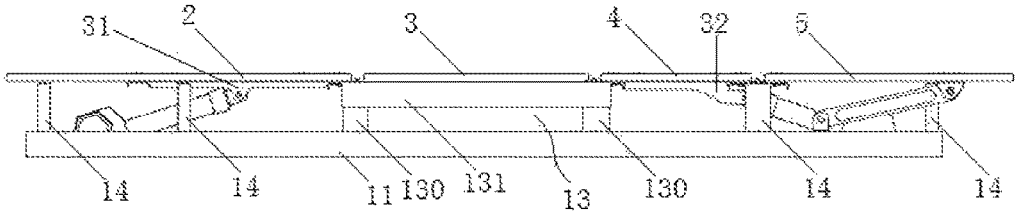
FIG. 2 is a side view of the adjustable electric bed in FIG. 1 positioned at the horizontal plane.
Figure 3:
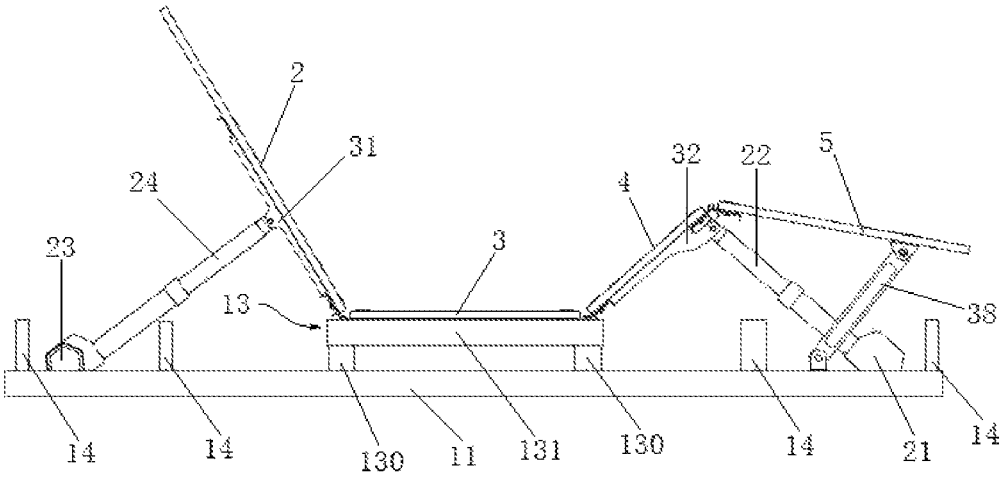
FIG. 3 is a side view of the adjustable electric bed in FIG. 1 positioned at the regulating position.

Referring to FIGS. 1-3, the substantially rectangular frame of the bed frame consists of a pair of longitudinal beams 11 and a pair of transverse beams 12, wherein the fixed platform 13 is arranged at the intermediate position of the longitudinal beams 11, and the fixed blocks 14 are separately arranged at the longitudinal beams 11 and the transverse beams 12, so as to share the load to be born when the bed boards are positioned horizontally.

The fixed platform 13 comprises bases 130 and a fixed beam 131, wherein each fixed platform consists of two bases 130 of the same height and one fixed beam 131 fixed at the bases 130. The fixed bed board 3 and the fixed beam 131 are rigidly connected with each other in a known manner.

The pair of transverse beams 12 of the bed frame is fixed provided with an articulating base 15 for articulating the driving motor. Preferentially, the articulating base 15 is arranged at the position of the center line of the transverse beams 12. Specifically, the bed frame is made of cold-drawn steel for furniture tube, and the entire bed frame has light weight and high weld strength and is not easily deformed.

Figure 4:
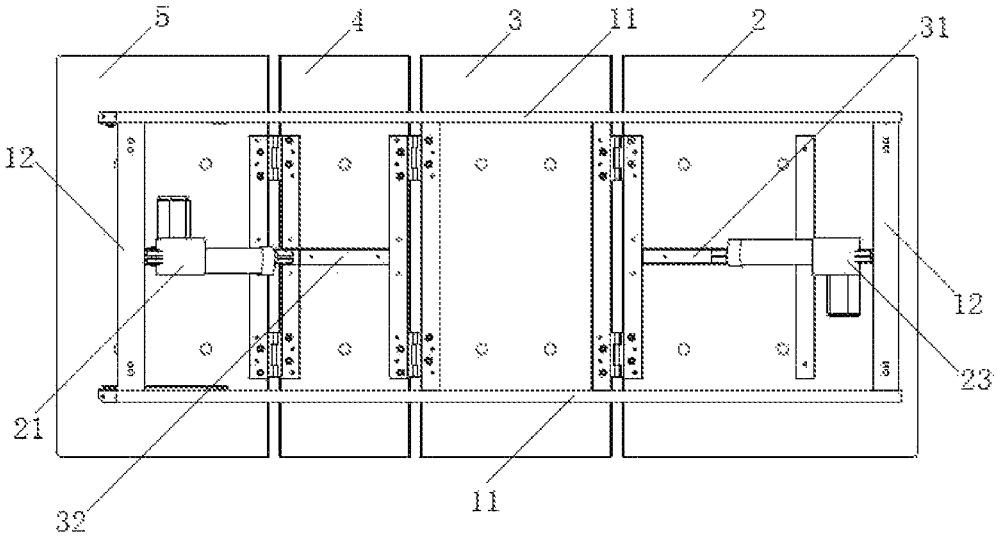
FIG. 4 is an upward view of the adjustable electric bed in FIG. 1 positioned at the horizontal plane.

Referring to FIGS. 3 and 4, the undersurfaces of the head bed board 2 and of the leg bed board 4 are fixedly provided with a head connector 31 and a leg connector 32, for example by means of riveting, screwing, etc., which fix the head connector 31 and the leg connector 32 at the undersurfaces of the head bed board 2 and of the leg bed board 4 respectively, so as to transfer the moment generated by the motor, wherein the head connector 31 extends from the hinge joint between the head bed board 2 and the fixed bed board 3, the extending length is at least one third, in particular half, of that of the head bed board, this head connector 31 is provided with the articulating base for articulating the head motor, the articulating base is at the intermediate position of the head connector 31, and the projections of the articulating base at this head connector 31 and of the articulating base 15 in the transverse beams 12 on the head bed board 2 are on one straight line.

Likewise, the leg connector 32 extends from the hinge joint between the leg bed board 4 and the fixed bed board 3, the extending length is at least half of the length of the leg bed board 4, in particular is the length of the entire leg bed board 4, this leg connector 32 is provided with the articulating base for articulating the leg motor, the articulating base is close to the hinge joint between the leg bed board and the foot bed board, and the projections of the articulating base at this leg connector 32 and of the articulating base 15 in the transverse beams 12 on the leg bed board are on one straight line.

The head motor and the leg motor respectively have drive ends and push rods, wherein the drive end 23 of the head motor is articulated with the articulating base 15 of the transverse beams 12 near the head bed board, and the end of its push rod 24 is articulated with the articulating base of the head connector 31 at the undersurface of the head bed board 2; the drive end 21 of the leg motor is articulated with the articulating base of the transverse beams 12 near the leg bed board, and the end of its push rod 22 is articulated with the articulating base of the leg connector 32 at the undersurface of the leg bed board 4.

The drive ends of the head motor and the leg motor and the ends of their push rods are arranged not within the same horizontal plane, and the sections of the push rods of the head motor and the leg motor may be designed as I-shaped, which not only enhances the strength of the boards, but also reduces the deformation of the boards when bearing the force under the drive by the motor.

The projections of the head motor and the leg motor on the horizontal plane in which the bed frame is located are on one straight line.

The foot bed board 5 is connected with the bed frame by the movable support bar 38. Specifically, the undersurface of the foot bed board 5 is fixedly provided with the articulating base used for articulating the support bar 38, at the same time, the longitudinal beam 11 is provided with the articulating base for articulating the support bar 38 at the position near the foot bed board, and the support bar 38 is articulated between the foot bed board 5 and the bed frame by said articulating base. When the leg motor drives the leg bed board 4 to rise and fall, this support bar supports the foot bed board 5.

The above embodiments are only used as examples, without limiting the scope of the invention. A person skilled in the art may envisage other embodiments which can realize the same function, within the protection scope of the claims of the invention, on this basis.

A person skilled in the art masters various embodiments, various variants and improvements. In particular, it should be cleared that the above features, variants and/or specific embodiments of the invention may be combined with each other, except the case of apparent contradiction or incompatibility. All these embodiments, variants and improvements belong to the protection scope of the invention. For example, alternatively, the drive ends of the head motor are able to be articulated at the head connector of the undersurface of the head bed board, and the end of its push rod is articulated at the articulating base of the bed frame; likewise, the drive ends of the leg motor are able to be articulated at the leg connector of the undersurface of the leg bed board, and the end of its push rod is articulated at the articulating base of the bed frame.

What is claimed is:

1. An adjustable electric bed (1), including comprising:

a bed frame, a plurality of bed boards articulated mutually and a driving device for driving the plurality of bed boards to rise and fall;

the plurality of bed boards at least comprise a head bed board (2), a fixed bed board (3), a leg bed board (4) and a foot bed board (5) which are articulated successively, the fixed bed board (3) is fixed with the bed frame;

wherein, an undersurface of the head bed board (2) is fixedly provided with a head connector (31), the driving device at least comprises a head motor and a leg motor, two ends of the head motor are respectively articulated with the bed frame and the head connector (31), an undersurface of the leg bed board (4) is fixedly provided with a leg connector (32), two ends of the leg motor are respectively articulated with bed frame and the leg connector (32).

2. The adjustable electric bed (1) according to claim 1, wherein the foot bed board (5) is connected with the bed frame by a movable support bar (38), one end of the support bar (38) is articulated with said bed frame, the other end is articulated with the foot bed board (5), and when the leg motor drives the leg bed board (4) to rise and fall, the support bar supports the foot bed board (5).

3. The adjustable electric bed (1) according to claim 1, wherein the bed frame comprises a fixed platform (13) protruding upwards from a horizontal plane of the bed frame and several fixed blocks (14), the fixed platform (13) is used for fixing the fixed bed board (3), said several fixed blocks (14) play a role of supporting when the head bed board (2), the leg bed board (4) and the foot bed board (5) are at a horizontal plane.

4. The adjustable electric bed (1) according to claim 3, wherein at least one of said several fixed blocks (14) is fixed at a position on the bed frame corresponding to a hinge joint of the leg bed board (4) and the foot bed board (5) at a horizontal plane.

5. The adjustable electric bed (1) according to claim 1, wherein each one of the head motor and the leg motor comprises a drive end and a push rod, for the head motor the drive end (23) is articulated with the bed frame and the push rod end (24) is articulated with the head bed board (2); for the leg motor the drive end (21) is articulated with the bed frame and the push rod end (22) is articulated with the leg bed board (4).

6. The adjustable electric bed (1) according to claim 5, wherein the drive ends and the push rod ends of the head motor and the leg motor are located in two different horizontal planes respectively.

7. The adjustable electric bed (1) according to claim 1, wherein the head connector (31) and the leg connector (32) are respectively arranged at the undersurfaces of the head bed board (2) and of the leg bed board (4) along a straight line.

8. The adjustable electric bed (1) according to claim 7, wherein the head connector (31) and the leg connector (32) are arranged respectively along a center lines of the head bed board (2) and of the leg bed board (4).

9. The adjustable electric bed (1) according to claim 1, wherein a length of the head connector (31) and a length of the leg connector (32) are respectively longer than a half length of the head bed board (2) and a half length of the leg bed board (4).

10. The adjustable electric bed (1) according to claim 1, wherein the bed frame is made of cold-drawn steel for furniture tube.

* * * * *